United States Patent [19]

Speich

[11] Patent Number: 4,724,872

[45] Date of Patent: Feb. 16, 1988

[54] METHOD FOR THE CONTROL OF A WEAVING LOOM AND WEAVING LOOM FOR IMPLEMENTING SUCH METHOD

[75] Inventor: Francisco Speich, Gipf-Oberfrick, Switzerland

[73] Assignee: Textilma AG, Hergiswil, Switzerland

[21] Appl. No.: 912,250

[22] PCT Filed: Jan. 17, 1986

[86] PCT No.: PCT/CH86/00006

§ 371 Date: Sep. 16, 1986

§ 102(e) Date: Sep. 16, 1986

[87] PCT Pub. No.: WO86/04365

PCT Pub. Date: Jul. 31, 1986

[30] Foreign Application Priority Data

Jan. 17, 1985 [CH] Switzerland ..... 230/85

[51] Int. Cl.[4] ..... D03D 51/08

[52] U.S. Cl. ..... 139/1 E; 139/1 R; 139/336

[58] Field of Search ..... 139/1 E, 1 R, 336, 349, 139/353

[56] References Cited

U.S. PATENT DOCUMENTS

| | | | |
|---|---|---|---|
| 4,448,220 | 5/1984 | Zwiener et al. | 139/1 E |
| 4,474,220 | 10/1984 | Palau | 139/1 E |
| 4,488,580 | 12/1984 | Sainen et al. | 139/336 |
| 4,537,226 | 8/1985 | Gotoh | 139/1 E |
| 4,553,569 | 11/1985 | Kimbara et al. | 139/1 E |
| 4,570,681 | 2/1986 | Wada | 139/1 E |
| 4,659,051 | 4/1987 | Speich | 139/1 E |
| 4,669,510 | 6/1987 | Speich | 139/1 E |

FOREIGN PATENT DOCUMENTS

| | | |
|---|---|---|
| 0010530 | 4/1980 | European Pat. Off. . |
| 0094089 | 11/1983 | European Pat. Off. . |
| 0100939 | 2/1984 | European Pat. Off. . |
| 2300834 | 9/1976 | France . |

*Primary Examiner*—Harvey C. Hornsby
*Assistant Examiner*—Joseph S. Machoga
*Attorney, Agent, or Firm*—Toren, McGeady & Associates

[57] ABSTRACT

A method of controlling a weaving machine which includes a shedding device with yarn guiding eyelets, an electronic control device for the shedding device, a warp let-off device and a fabric take-off device, the electronic control device having a program memory providing a weaving program with weaving program steps and an auxiliary program, comprises stopping the weaving machine in a shed by means of a stop signal, switching by means of the auxiliary program to inverse weaving the shedding device and the weaving program step of the shed in which the weaving machine has stopped, returning by means of the auxiliary program the weaving machine to the next preceding shedding crossing point, stopping by means of the auxiliary program the weaving machine in this next preceding shedding crossing point so that the yarn-guiding eyelets are placed in a middle position, switching by means of the auxiliary program the weaving machine from inverse weaving to normal weaving according to the weaving program, and restarting the weaving machine with a start signal from the shedding crossing point utilizing the next following weaving program step.

6 Claims, 5 Drawing Figures

METHOD FOR THE CONTROL OF A WEAVING LOOM AND WEAVING LOOM FOR IMPLEMENTING SUCH METHOD

BACKGROUND OF THE INVENTION

The invention is directed to a method for the control of a weaving machine and a weaving machine for implementing the method.

Methods and weaving machines of the type mentioned in the beginning are known, for example, from CH-PS No. 590 358. In this method and this weaving machine, after the weaving machine is stopped because of the breaking of a warp yarn, the shafts are moved back into the shedding crossing point by means of the motor of a pick finder via the shedding device, from which shedding crossing point the weaving machine starts on a starting signal in phase balance with the weaving machine and triggers the continuation of the normal weaving process. This weaving machine contains no control device for controlling the shedding device in accordance with a weaving program. Possibly, a determined, simple weaving program with small repeat can be adjusted at the shedding device so as to be fixed. However, an accurate warp yarn coordination cannot be achieved then, since certain yarn guiding eyelets remain in the upper shed or in the lower shed in the shedding crossing point, also, because of the weaving design. An exact warp yarn coordination would only occur during linen weave, i.e. 1/1 weave. When coordination is lacking it is more difficult on the one hand to find the broken warp yarn, which can likewise be located in the lower shed, the upper shed or the middle shed, and, on the other hand, it is more difficult to join together the broken warp yarn ends because of the poor accessibility. In addition to this, during stoppage of the weaving machine, a longer stopping leads to considerable stretching of the warp yarns located in the upper shed and lower shed, particularly relative to those warp yarns located in the middle shed. Because of this, fabric defects which could lead to waste occur after the error is corrected and the weaving machine is started again.

A weaving machine with an electronic control device for the control of a shedding device in accordance with a weaving program is known from EP-OS No. 0 116 292, wherein a reverse switching gear unit is located for pick finding. However, the weaving machine contains no means for warp yarn coordination.

It is the object of the invention to find a method for operating a weaving machine and a weaving machine for implementing the method by means of which the aforementioned disadvantages can be avoided.

SUMMARY OF THE INVENTION

In accordance with the present invention, a method of controlling a weaving machine which includes a shedding device with yarn guiding eyelets, an electronic control device for the shedding device, a warp let-off device and a fabric take-off device, the electronic control device having a program memory and a process-control computer, the program memory providing a weaving program with weaving program steps and an auxiliary program, comprises stopping the weaving machine in a shed by means of a stop signal, switching by means of the auxiliary program to inverse weaving the shedding device and the weaving program step of the shed in which the weaving machine has stopped, returning by means of the auxiliary program the weaving machine to the next preceding shedding crossing point, stopping by means of the auxiliary program the weaving machine in this next preceding shedding crossing point so that the yarn-guiding eyelets are placed in a middle position, switching by means of the auxiliary program the weaving machine from inverse weaving to normal weaving according to the weaving program, and restarting the weaving machine with a start signal from the shedding crossing point utilizing the next following weaving program step.

Furthermore, the stop signal can be triggered, for example, by means of a hand switch for turning off the weaving machine or an error signal of a warp yarn guide. When the stop signal is generated, the auxiliary program switches the weaving program step of the shed in which the weaving machine stops, as well as the shedding device, to inverse weave, i.e. the opposite or negative weave, all yarn guiding eyelets must compulsorily arrive in the middle position during the return of the weaving machine into the last shedding crossing point for occupying the inverse position, no matter how complicated the weaving program may be. Accordingly, a complete warp yarn coordination is achieved in the middle position so that the warp yarns cannot be stretched differently and are optimally accessible, wherein, in particular, an incorrect warp yarn can also be found quickly, since all warp yarns lie in a plane. Accordingly, no defects of the woven fabric occur even during a longer interruption of the weaving process. Moreover, the optimum accessibility makes it possible to rapidly join together the ends of a broken warp yarn.

It is advisable that the weaving machine be stopped in the open shed after a program read-in point.

It is particularly advisable to proceed so that the special stop signal, for example, the error signal of the warp stop motion, immediately prevents the introduction of another filling yarn until the weaving machine is started.

It may possibly be advisable to set back the fabric take-off and, under certain circumstances, the warp let-off, by a restoring magnitude in order to prevent possible errors in the fabric web of fine fabrics. The correction factor of the restoring magnitude is freely selectable and depends, as a rule, on the characteristics of the fabric to be produced. Therefore, the correction factor is only adjusted once during the production of a certain fabric and is changed only when the type of fabric is changed.

The special stop signal can be an error signal of a warp yarn guide. However, it can also be released in an advisable manner by means of a hand switch if the weaving machine is to be stopped for longer periods, for example, overnight or over the weekend.

Also disclosed is a weaving machine which according to the present invention includes a shedding device, an electronic control device for controlling the shedding device, a warp let-off device, a fabric take-off device, a transmitter for generating the stop signal, means for stopping and moving back the weaving machine to a shedding crossing point, the electronic control device including a process-control computer and a memory for a weaving program with weaving program steps and an auxiliary program responding to the stop signal, the auxiliary program being capable of switching to inverse weaving the shedding device and the weaving program step of the shed in which the weaving machine has stopped, returning the weaving machine to the next preceding shedding crossing point, stopping the weaving machine in this next preceding shedding crossing point so that the yarn-guiding eyelets of the shedding device are placed in a middle position, switching the weaving machine from inverse weaving to normal weaving according to the weaving program, and restarting the weaving machine with a start signal from the shedding crossing point utilizing the next following weaving program step.

Embodiment examples of the subject matter of the invention are described in more detail in the following with the aid of the drawings:

DETAILED DESCRIPTION OF THE INVENTION

Figure 1:
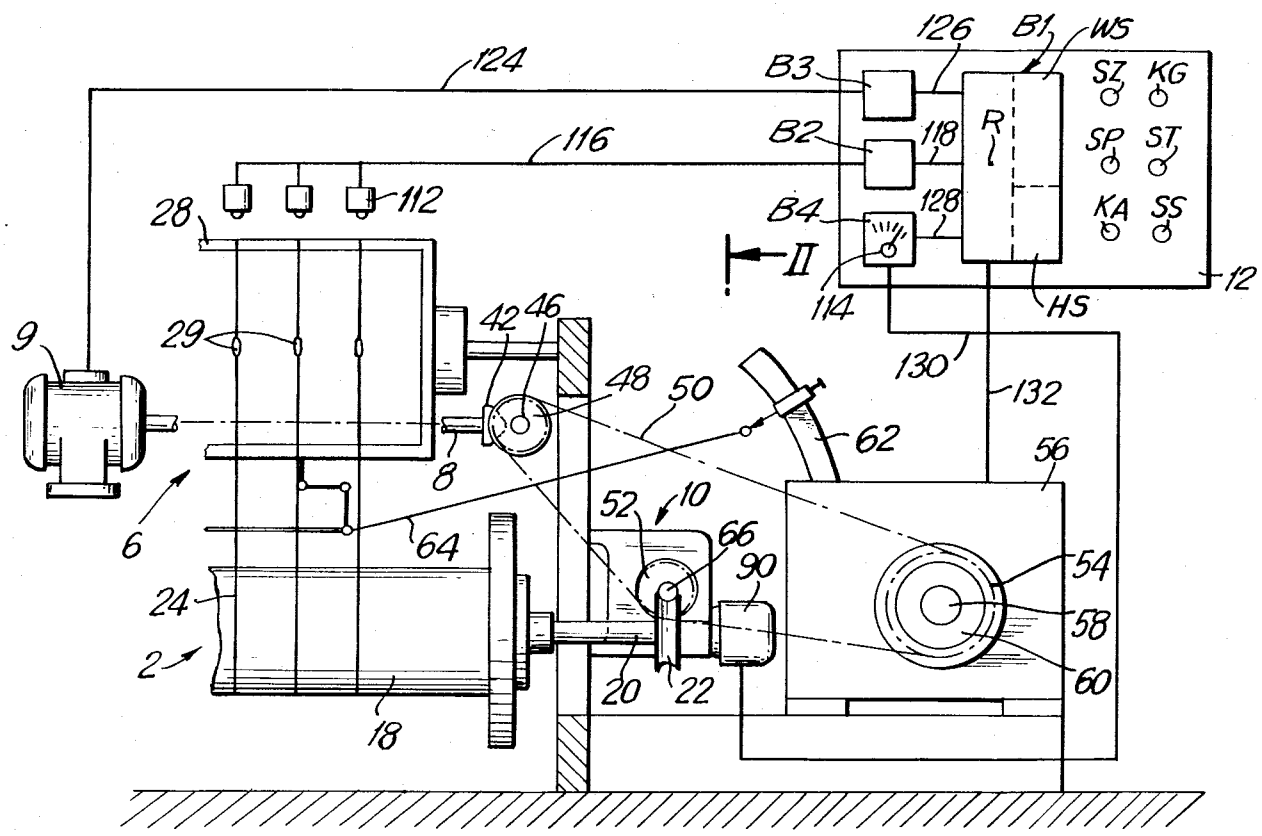
FIG. 1 shows a weaving machine in section and in a front view of the warp let-off device.
Figure 2:
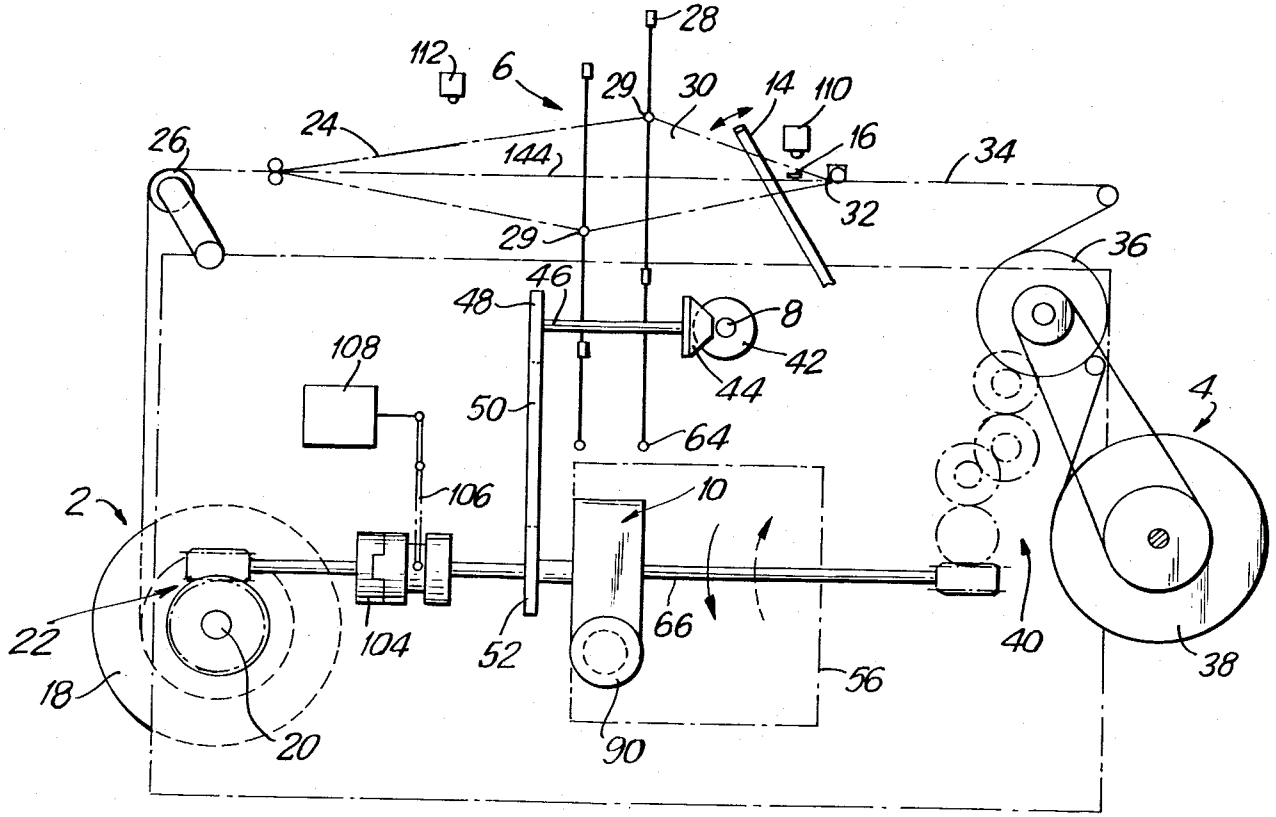
FIG. 2 shows the weaving machine of FIG. 1 in section II—II of FIG. 1.

FIGS. 1 to 4 show an embodiment example of a weaving machine comprising a warp let-off device 2, a fabric take-off device 4, a shedding device 6, a main drive 8 with a drive motor, a reverse switching gear unit 10, which is connected with the warp let-off device 2 and the fabric take-off device 4, and an electronic control device 12 for a weaving program. A weaving reed 14 and a filling yarn inserting member 16 are connected to the main drive 8 in a manner known, for example, from CH-PS No. 633 331 and not shown in more detail.

The warp let-off device 2 contains a warp beam 18 whose shaft 20 is driven by means of a worm gear unit 22. The warp yarns 24 reach from the warp beam 18 via a back rest 26 to the shafts 28 with the yarn guiding eyelets 29 of the shedding device 6 which serve to form and change the warp shed 30. The filling yarn inserting member 16 periodically engages in the warp shed 30. The inserted filling yarn is beaten up at the selvage 32 by means of the weaving reed 14. The woven fabric 34 is tensioned and taken off via the tension beam 36 and is rolled up on the fabric beam 38. The fabric take-off device 4 containing the tension beam 36 and the fabric beam 38 is driven by means of a regulating gear unit 40.

For the drive of the warp let-off device 2, the fabric take-off device 4 and the shedding device 6, a secondary drive shaft 46 is connected to the main drive 8 via bevel wheels 42, 44. This secondary drive shaft 46 carries a toothed wheel 48 which drives a drive wheel 52 for the warp let-off device 2 and the fabric take-off device 4, as well as a drive wheel 54 for the shedding device 6, via a toothed belt 50.

The shedding device 6 contains a dobby 56, whose drive shaft 58 is connected with the drive wheel 54, possibly with the intermediary of a switching coupling 60. The dobby 56, which is constructed and controlled, for example, according to EP-OS No. 0 056 098 and EP-OS No. 0 068 139, has shaft rockers 62 which are connected in each instance with a shaft 28 via a lever gear 64. Another type of shedding device with single strand control, e.g. according to DE-OS No. 33 01 931, can also be used.

Figure 3:
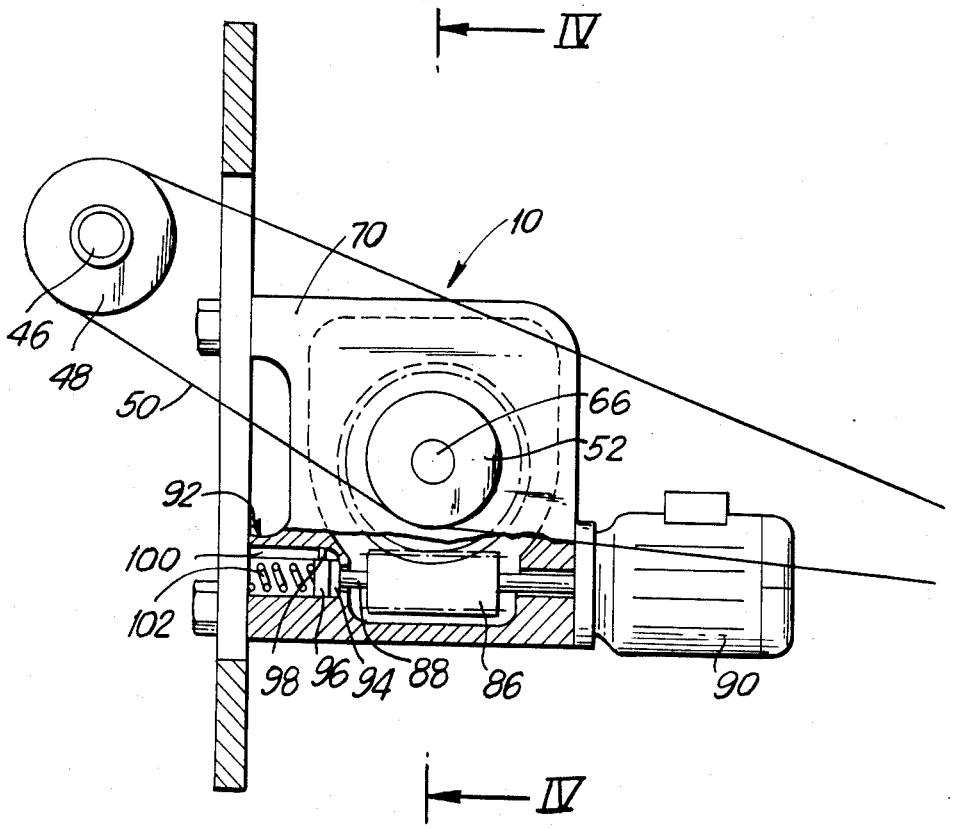
FIG. 3 shows the reverse switching gear unit in side view.
Figure 4:
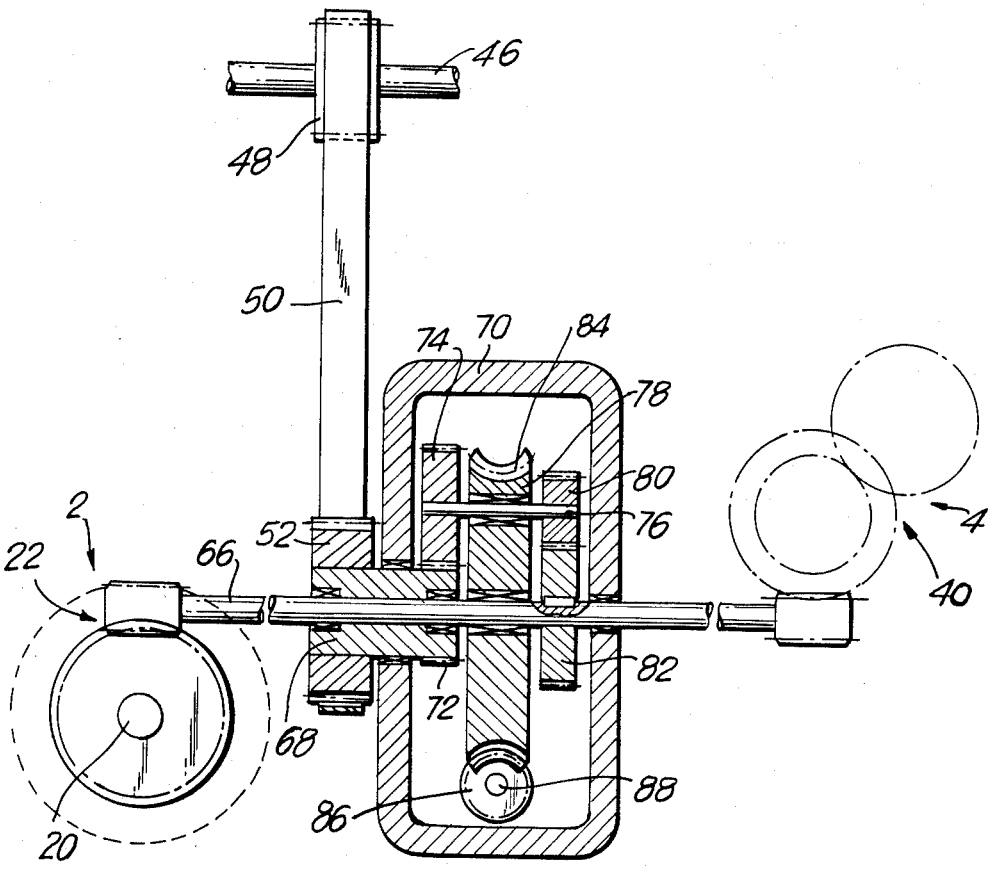
FIG. 4 shows the reverse switching gear unit in section IV—IV of FIG. 3.

The drive wheel 52 for driving the warp let-off device 2 and the fabric take-off device 4 is connected with a drive shaft 66 via the reverse switching gear unit 10, which is constructed as overlapping gear unit, the drive shaft 66 drives the worm gear unit 22 of the warp let-off device 2 on the one hand and the regulating gear unit 40 of the fabric take-off device 4 on the other hand. The drive wheel 52 is arranged at a bearing sleeve 68, see FIG. 4, which is supported on the drive shaft 66 so as to be freely rotatable. The bearing sleeve 68 projects into a housing 70 and carries a toothed wheel 72 with which a planet wheel 74 meshes. The latter is arranged at a shaft 76 so as to be fixed with respect to rotation relative to it; the shaft 76 is rotatably supported in a planet carrier 78 which is in turn rotatably supported on the drive shaft 66. At the shaft 76, on the other side of the planet carrier 78, another planet wheel 80 is connected with the shaft 76 so as to be fixed with respect to rotation relative to it. The second planet wheel 80 meshes with a toothed wheel 82 which is arranged at the drive shaft 66 so as to be fixed with respect to rotation relative to it. The planet carrier 78 is constructed as a worm wheel and contains at its circumference a worm toothing 84 which cooperates with a worm wheel 86 whose drive shaft 88 is connected with an auxiliary motor 90. The worm gear unit, which is formed from the worm toothing 84 and the worm wheel 86 is preferably constructed so as to be self-locking. Moreover, as shown in FIG. 3, the reverse switching gear unit 10 is equipped with a brake device 92 for preventing an after-running. The brake device 92 comprises a friction disk 94 which is arranged on the drive shaft 88 so as to be fixed with respect to rotation relative to it and a friction disk 96, which is arranged in the housing 70 so as to be fixed with respect to rotation relative to it, cooperates with the friction disk 94. A peg 98 arranged at the friction disk 96 engages in a groove 100 in the housing 70 which lies parallel to the drive shaft 88 and prevents a turning of the friction disk 96. A pretensioning spring 102 pretensions the stationary friction disk 96 against the friction disk 94 which is connected with the drive shaft 88.

The drive shaft 66 is interrupted at the portion going toward the the warp let-off device 2 by means of a switching coupling 104. This switching coupling is constructed, for example, as a claw coupling which is switchable by means of a switching lever 106 and an actuating device 108 so that the drive of the warp let-off device 2 can be shut off when necessary.

The weaving machine is equipped with electronic control device 12 which is connected, on the one hand, with the dobby 56 of the shedding device 6 and, on the other hand, with the drive motor 9 and with the auxiliary motor 90 of the reverse switching gear unit. Thread regulators, such as the filling stop motion 110 and the warp stop motion 112, are connected at the control device 12. The electronic control device has the usual construction of a control with programmable memory. It contains a central unit B1 with a freely programmable weaving program memory WS, e.g. a RAM memory, and an auxiliary program memory HS and a process control computer R which processes all signals and information for the control of the weaving machine. In addition, the control device contains various control blocks and a series of press buttons for triggering various functions:

B1—central unit
B2—warp yarn error control block
B3—weaving machine drive control block
B4—fabric take-off control block with correction factor adjustment
WS—weaving program memory
HS—auxiliary program memory
ST—normal start
SP—normal stop
SS—special stop
SZ—preparation of pick finding cycle
KG—normal creeping speed forward
KA—restoring magnitude release key The restoring magnitude G is input beforehand and so as to be specific for the fabric by means of the correction switch 114 and is released by means of the release key KA. The correction factor K can be freely selected, for example, according to normal or longer stoppage of the weaving machine; warp thread breakages; pick finding etc., and is decisive for restoring the fabric take-off per program step to be set back. The restoring magnitude G is:

$$G=K\times L,$$

wherein
L designates fabric length between two fillings
K designates the correction factor, wherein K=0.1 to 4.

In the control device 12 the warp yarn error control block B2 is connected with the warp stop motions 112 via a line 116 and with the central unit B1 via a line 118. The weaving machine drive control block B3 is connected to the drive motor 9 via a line 124 and to the central unit B1 via a line 126. Finally, the fabric take-off control block B4, which contains the correction switch 114 for adjusting the restoring magnitude G, is connected with the central unit B1 by means of the line 128 and with the auxiliary motor 90 of the reverse switching gear unit 10 via the line 130. The central unit B1 is connected to the dobby 56 via the line 132.

The electronic control device makes it possible to switch back the weaving program when the weaving machine is running forward so that the dobby 56, which is being driven in the forward direction, executes a reverse program flow. At the same time, the control device controls the weaving machine drive motor 9 and the auxiliary motor 90 of the reverse switching gear unit 10 so that the warp let-off device 2 and particularly the fabric take-off device 4 can be switched back, as explained in more detail in the following, for error correction during the breaking of a filling yarn and/or warp yarn. However, the control device can also let the entire weaving machine run in reverse.

Figure 5:
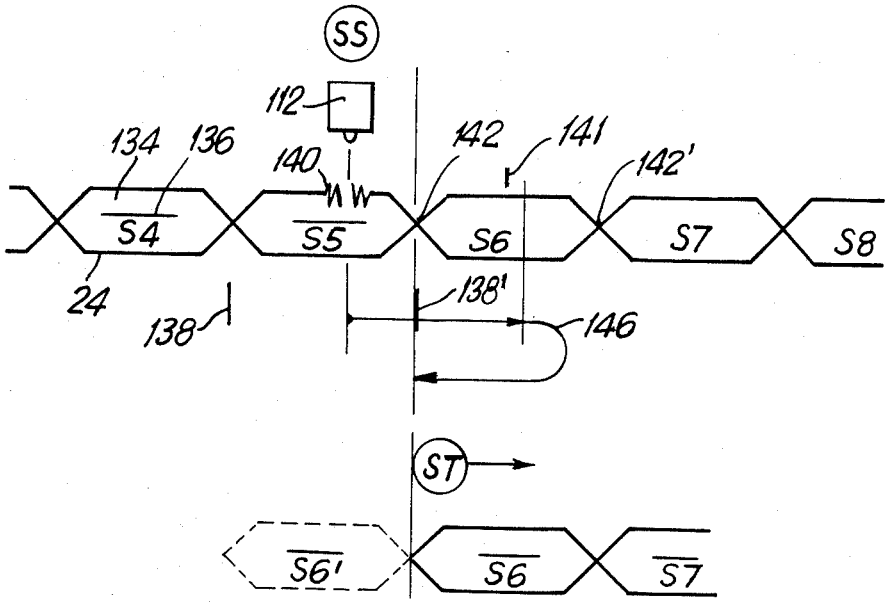
FIG. 5 shows a shed diagram in various phases of error removal during a breaking of warp yarn in reverse switching of the weaving program.

FIG. 5 shows a shed diagram for a weaving machine. The individual sheds 134 formed from warp yarns 24 carry the respective weaving program steps S4, S5, S6, S7, S8 in each instance. Filling yarns 136 are inserted in the individual sheds 134. The clock pulse for the continued switching of the weaving program is taken off at a clock point 138 in each instance. The clock pulse can serve for the continued switching of the weaving program of the next respective shed or, as in the present example, the shed after the next shed.

The removal of a warp yarn breakage is effected as follows:

When the warp stop motion 112 establishes a warp yarn breakage 140 in the shed 134, for example, with the weaving program step S5, then the weaving machine is stopped in the next open shed with the weaving program step S6, specifically after the program read-in point 141. At the next shedding crossing point 142' the next weaving program step S7 would be activated because of the last clock point 138'. However, because of the error signal of the warp stop motion 112, the continued switching of the weaving program in the weaving program memory WS of the central unit B1 is interrupted and switched to an auxiliary program of the auxiliary program memory HS for the middle position of the shafts 28. In order to adjust the shedding device at the shedding crossing point 142 in such a way that all yarn guiding eyelets 29 of the shafts 28 occupy the middle position 144 (FIG. 2), the shedding device is moved back further or to the last shedding crossing point 142, respectively, on the basis of the auxiliary program corresponding to the curve 146. The respective weaving program step S6, and accordingly also the shedding device, is switched in the inverse weaving program step S6'. Because of this switching to the inverse weave all shafts and, with them, all yarn guiding eyelets, must occupy the negative, i.e. opposite position. This reverse movement is effected during the reverse movement into the shedding crossing point in which all shafts and, accordingly, all yarn guiding eyelets compulsorily occupy the middle position. In order to carry out this reverse movement the drive motor 9 is switched in its rotating direction. At the same time, the control device can move back the fabric take-off and possibly the warp let-off by a corresopnding restoring magnitude G by means of the central unit B1 and the fabric take-off control block B4, wherein this magnitude is correctable by a correction factor K, possibly at the correction switch 114. The warp yarn breakage is now removed and the weaving machine is again turned on at the start key ST; in so doing, the auxiliary program switches the control device to normal program again so that the shedding device again occupies the consequent weaving program position at the shedding crossing point 142. The weaving process is now continued again in the consequent position as can be seen from the lower shed diagram of FIG. 5.

As soon as a warp yarn breakage signal occurs at the warp stop motion 112 a further insertion of filling yarns 136 in the sheds 134 is prevented. Possibly, it can be advisable to remove an already inserted filling yarn 136.

The special stop signal caused by the error signal described above can also be released by means of the special stop key SS, wherein the same processes are released as with the error signal. The single difference consists in that the error removal is omitted. While the normal stop key SP is always released when an immediate stop is desired, the special stop key is actuated when a middle position of the yarn guiding eyelets is desired. The latter can be the case when the weaving machine is reset and particularly during a longer stoppage of the weaving machine in order to prevent different stretching of the warp yarns and, accordingly, woven fabric defects.

Other embodiment examples are possible. Instead of the reverse movement of the entire weaving machine, the dobby of the shedding device can also be uncoupled from the main drive and set back by itself by means of an auxiliary drive.

What is claimed is:

1. A method of controlling a weaving machine which includes a shedding device with yarn-guiding eyelets, an electronic control device for the shedding device, a warp let-off device and a fabric take-off device, the electronic control device having a program memory and a process-control computer, the program memory providing a weaving program with weaving program steps and an auxiliary program, comprising stopping the weaving machine in a shed by means of a stop signal, switching by means of the auxiliary program to inverse weaving the shedding device and the weaving program step of the shed in which the weaving machine has stopped, returning by means of the auxiliary program the weaving machine to the next preceding shedding crossing point, stopping by means of the auxiliary program the weaving machine in said next preceding shedding crossing point so that the yarn guiding eyelets are placed in a middle position, switching by means of the auxiliary program the weaving machine from inverse weaving to normal weaving according to the weaving program, and restarting the weaving machine with a start signal from the shedding crossing point utilizing the next following weaving program step.

2. Method according to claim 1, comprising stopping the weaving machine in the open shed after a program read-in point.

3. Method according to claim 1, wherein the stop signal prevents the insertion of a filling yarn until the start signal is generated.

4. Method according to claim 1, wherein the fabric take-off device and the warp let-off device are set back by a restoring magnitude G, wherein $$G = K \times L$$

and

L designates the fabric length between two filling yarns

K designates the correction factor, wherein K = 0.1 to 4.

5. Method according to claim 1, wherein the stop signal is the error signal of a warp stop motion.

6. A weaving machine comprising a shedding device with yarn-guiding eyelets, an electronic control device for controlling the shedding device, a warp let-off device, a fabric take-off device, a transmitter for generating a stop signal, means for stopping and moving back the weaving machine to a shedding crossing point, the electronic control device including a process-control computer and a memory for a weaving program with weaving program steps and an auxiliary program responding to the stop signal, wherein the auxiliary program is capable of switching to inverse weaving the shedding device and the program step of the shed in which the weaving machine is stopped, returning the weaving machine to the next preceding shedding crossing point, stopping the weaving machine in said next preceding shedding crossing point so that the yarn-guiding eyelets are placed in a middle position, switching the weaving machine from inverse weaving to normal weaving according to the weaving program, and restarting the weaving machine with a start signal from the shedding crossing point utilizing the next following weaving program step.

* * * * *